United States Patent [19]

Cho

[11] Patent Number: 4,891,308

[45] Date of Patent: Jan. 2, 1990

[54] PHOTOGRAPHIC FILM ANTISTATIC BACKING LAYER WITH AUXILIARY LAYER HAVING IMPROVED PROPERTIES

[75] Inventor: Thomas B. Cho, East Brunswick, N.J.

[73] Assignee: E. I. Du Pont de Nemours and Company, Wilmington, Del.

[21] Appl. No.: 344,974

[22] Filed: Apr. 14, 1989

Related U.S. Application Data

[63] Continuation of Ser. No. 198,596, May 23, 1988, abandoned, which is a continuation-in-part of Ser. No. 126,524, Nov. 30, 1987, abandoned.

[51] Int. Cl.[4] ..... G03C 1/82

[52] U.S. Cl. ..... 430/527; 430/523; 430/531; 430/539

[58] Field of Search ..... 430/527, 539, 523, 531

[56] References Cited

U.S. PATENT DOCUMENTS

| | | | |
|---|---|---|---|
| 4,209,584 | 6/1980 | Joseph | 430/527 |
| 4,225,665 | 9/1980 | Schadt | 430/529 |
| 4,396,708 | 8/1983 | Ogawa et al. | 430/529 |
| 4,585,730 | 4/1986 | Cho | 430/527 |
| 4,675;278 | 6/1987 | Sugimoto et al. | 430/523 |
| 4,701,403 | 10/1987 | Miller | 430/529 |

*Primary Examiner*—Jack P. Brammer

[57] ABSTRACT

As part of a photographic film, a backing antistatic layer is coated at a pH of 3 to 12 with an auxiliary layer consisting essentially of at least one crosslinkable conductive polymer and a crosslinking agent for the conductive polymer dispersed in a binder, e.g., gelatin, to conduct the antistatic properties from the antistatic underlayer to the surface of the backing layer. The crosslinkable conductive polymer and crosslinking agent can be present in separate layers on the backing layer. The film is useful in the areas of graphic arts, printing, medical and information systems.

16 Claims, No Drawings

PHOTOGRAPHIC FILM ANTISTATIC BACKING LAYER WITH AUXILIARY LAYER HAVING IMPROVED PROPERTIES

This application is a continuation of application Ser. No. 07/198,596 filed May 23, 1988, which is a continuation-in-part of Ser. No. 07/126,524, filed Nov. 30, 1987, both now abandoned.

BACKGROUND OF THE INVENTION

CROSS-REFERENCE TO RELATED APPLICATIONS

This invention is related to Cho U.S. Pat. No. 4,585,730, "Antistatic Backing Layer with Auxiliary Layer for a Silver Halide Element", granted Apr. 29, 1986. This invention is also related to Miller U.S. Pat. No. 4,701,403, "Two-Layer Process for Applying Antistatic Compositions to Polyester Supports," granted Oct. 20, 1987, which is directed to a process applying a thin, clear antistatic layer to a photographic film. The present invention provides an auxiliary layer designed to be coated over such layer.

FIELD OF THE INVENTION

This invention relates to a photographic film. More particularly this invention relates to a photographic film having an improved auxiliary backing layer for said film which can conduct antistatic properties from an antistatic underlayer to the outside surface thereof.

BACKGROUND ART

Polymeric film supports for photographic film are known for their propensity to accumulate static charges. This is a particular problem where the film is designed to be handled by machine and to be processed rapidly over unlike surfaces. Static charges which may be generated at this time cannot be readily tolerated because discharging these may expose the photographic layer, or layers, coated thereon.

The use of so-called antistatic layers to prevent the build-up of these static charges is well known in the art. Schadt U.S. Pat. No. 4,225,665, describes one such composition comprising a mixture of (1) a water-soluble copolymer of the sodium salt of styrene sulfonic acid and a carboxyl-containing monomer, (2) a hydrophobic polymer containing carboxyl groups, and (3) a water-soluble polyfunctional aziridine. When this mixture is applied as a single layer to resin-subbed (resin-subcoated)poly(ethylene terephthalate), for examle, it provides excellent protection from the build-up of static charges (e.g., surface resistivity).

Miller U.S. Pat. No. 4,701,403 describes an improvement over the aforementioned Schadt patent wherein a polymer such as component (1), for example, is applied to the support in a first coating, optionally a composition containing component (2), and, after drying, aziridine component (3) is applied as a second coating contiguous thereto. This improved process permits the application of improved thinner antistatic layers without premature reaction of the aziridine with the other ingredients. Products from such premature reaction can sometimes plug and foul coating equipment, which is not commercially tolerable.

Cho U.S. Pat. No. 4,585,730 describes an auxiliary layer containing a conductive polymer as described therein. This layer is satisfactory in transporting antistatic properties from underlayers to the surface thereof.

However, occasionally the layer described in this patent suffers from certain disadvantages such as problems with anchorage and poor processability in the fluids in which the photographic layer is processed.

It is desired to provide an improved auxiliary layer over an antistatic layer of a photographic film which is useful in conducting antistatic properties to the surface thereof. Such a layer also serves as a backing layer for a photographic film which contains an antistatic layer thereon. It is also desired to provide such an auxiliary layer with good anchorage to previously applied layers and which is stable in photographic processing fluids.

SUMMARY OF THE INVENTION

In accordance with this invention there is provided a photographic film comprising a support, at least one silver halide emulsion coated on one side of said support, and an antistatic layer coated on the opposite side of said support, characterized in that the antistatic layer is coated at a pH of 3 to 12 with an auxiliary layer consisting essentially of at least one crosslinkable conductive polymer having functionally attached carboxylic acid groups, and a crosslinking agent for the conductive polymer dispersed in a gelatin binder, whereby the antistatic properties of the antistatic layer are conducted through the auxiliary layer.

DETAILED DESCRIPTION OF THE INVENTION

Consisting essentially of as used in the appended claims means that unspecified constituents or conditions are not excluded provided that they do not affect the advantage of the invention from being realized.

The crosslinkable conductive polymer may be present alone or in combination with at least one other crosslinkable conductive polymer. A particularly preferred crosslinkable conductive polymer is poly(sodium styrene sulfonate-maleic anhydride). Other crosslinkable, conductive polymers include: hexadecyl betaine, alkyldimethyl betaines wherein alkyl is 1 to 12 carbon atoms, carboxylated imidazolines, coco amido betaines, etc. These conductive polymers which contain functionally attached carboxylic acid groups may be added to the auxiliary layer of this invention in a range of 0.5 to 30% by weight of the gelatin binder, preferably at 1.5 to 2.5% by weight. The term "gelatin binder" denotes a binder wherein the major component is gelatin. Gelatin substitutes, e.g., polyvinyl alcohol, detran, cellulose derivatives, modified gelatins, a water-soluble acrylic latex, etc., may be present in minor amounts, e.g., less than 17% by weight.

Crosslinking agents useful within the ambit of this invention include polyfunctional aziridines such as those described in Schadt U.S. Pat. No. 4,225,665 and Miller U.S. Pat. No. 4,701,403. The disclosures relating to the aziridines are incorporated herein by reference. Other useful crosslinking (hardening) agents include: chrome alum, carbodiimides, isoxazolinium salts, etc. Particularly preferred is pentaerythritol-tri-beta-(2-methyl aziridine) propionate added to the gelatin binder. The crosslinking agent may be present in an amount of 0.5 to 5.0% by weight of the gelatin binder, preferably in an amount of 2.0 to 3.0% by weight.

A mixture of the gelatin binder in water, the crosslinkable conductive polymer and the crosslinking agent of this invention is made up prior to coating. Other additives such as, for example, antihalation dyes, surfactants, wetting agents and hardeners, etc., may also be present in the mixture. At this point, just prior to coating, the pH is adjusted to 3 to 12, preferably 6 to 8.

The aqueous caoting composition made as described above may be applied with good results to any of the conventional photographic film supports but the preferred support is poly(ethylene terephthalate) subcoated with a layer of layers of conventional resins and bearing on one side a photosensitive layer, preferably a silver halide emulsion layer, and on the other side as a backing layer a layer of an antistatic composition, e.g., antistatic coatings of Schadt U.S. Pat. No. 4,225,665, Miller U.S. Pat. No. 4,701,403, etc. The invention is not limited to any particular antistatic coating; however, the antistatic coatings of Miller, U.S. Pat. No. 4,701,403 are preferred (see particularly column 3, line 56 to column 4, line 56, the disclosure of which is incorporated herein by reference). The backing layer of this invention is then coated over the antistatic layer at a coating weight of about 30 to 90 mg/dm$^2$, preferable about 40 to 60 mg/dm$^2$.

Thus, in a particularly preferred mode, this invention is represented by a photographic film element which comprises a support, which is preferably dimensionally stable polyethylene terephthalate suitably subbed on both sides with a thin, anchoring substratum of a conventional resin sub over which may be applied a gelatin sublayer. On one side of this support a standard silver halide emulsion layer may be applied and this layer then overcoated with a protective overcoat layer, e.g., a conventional hardened gelatin, abrasion layer. On the side opposite to the side containing the emulsion layer, the antistatic layer of Miller U.S. Pat. No. 4,701,403 is preferably applied followed by an auxiliary layer represented by this invention. The layer of this invention may be an antihalation layer or may be coated simply as a gelatin anti-curl layer, as is well-known to those of normal skill in the art.

In another embodiment, the auxiliary layer can be replaced by two separately coated layers, each layer containing gelatin, one layer of which contains at least one crosslinkable conductive polymer and the other layer of which contains a crosslinking agent, both as described and in the amounts set out above. For example, the conductive polymer dispersed in some gelatin may be coated first followed by a coating of gelatin and crosslinking agent. When wet, the crosslinking agent will migrate into the conductive polymer-containing layer effectively serving to crosslink gelatin and polymer as described above.

When the layer of this invention is made as taught herein, many advantages are obtained. First, this layer will provide the desired transmission of antistatic properties from the antistatic layer to the surface of the film. Next, the layer of this invention is stable and will survive the rigors of photographic processing without disintegration. This is very desirable since prior art layers tended to flake off during the processing steps. Loss of layer integrity is a defect that cannot be tolerated since particles of the layer tend to foul the processing fluids and, more importantly, cause loss of antistatic transmission properties. Additionally, the adhesion between previously coated or subsequently coated layers is enhanced by the presence of a layer of this invention over those of the prior art. This is a surprising result since layers very similar to those described herein, which have the required hardness from gelatin hardeners, among others, and are satisfactory in transmitting the antistatic properties, do not have the characteristics described above.

While not being limited, it is theorized that the crosslinking agents, such as those described above, interconnect the gelatin, the conductive polymer and the carboxyl groups available on the surface of the antistatic underlayer providing excellent adhesion. It is surprising, however, that transmission of the antistatic properties is maintained since it was thought that the conductive polymer should have all of the groups on the polymer chains available to provide transmission of the antistatic properties.

A host of conventional photosensitive materials may be present as the emulsion layer described above. These include photopolymer, diazo, vesicular image-forming materials, etc. The films described may be used in any of the well-known imaging fields such as graphic arts, printing, medical and information systems, among others. The photographic film of this invention is particularly useful in processes where rapid transport and handling by machines are practiced such as phototypesetting applications, for example. Particularly useful elements include the so-called "bright-light" films which can be handled in relatively bright safelights, for example.

EXAMPLES

This invention will now be illustrated but not limited by the following examples wherein the percentages are by weight.

EXAMPLES 1 TO 5

A backing layer antihalation solution was prepared by mixing 1200 g of gelatin in 13,530 g of distilled water for 15 minutes at 49° C. The mixture was cooled to 38° C. and the following ingredients added:

| Ingredients | Amount (g) |
|---|---|
| 4.2% aqueous solution of sodium octyl phenoxy diether sulfonate wetting agent (Triton ® X200, Rohm & Haas Co.) | 720.0 cc |
| ethyl alcohol | 450.0 |
| distilled water | 1050.0 |
| SF Yellow Dye(1) (4.7% in $H_2O$) | 108.0 |
| S—1240 Dye(2) (16.0% in $H_2O$) | 50.0 |
| Acid Violet Dye(3) (12.0% in $H_2O$) | 54.0 |
| polyethyl acrylate latex (32.5% in $H_2O$) | 540.0 |
| 6% aqueous solution of sodium myristyl triether sulfate wetting agent (Standapol ® ES40, Henkel Inc., U.S.A.) | 250.0 |
| sodium hydroxide (3N) | 18.0 |
| 5% aqueous solution of perfluoroalkyl carboxylate (FC-127 ®, 3M Co.) | 270.0 |
| silica matte (12 mμ, Davidson Chemical Co.) | 5.3 |

(1)SF Yellow (D782)

-continued

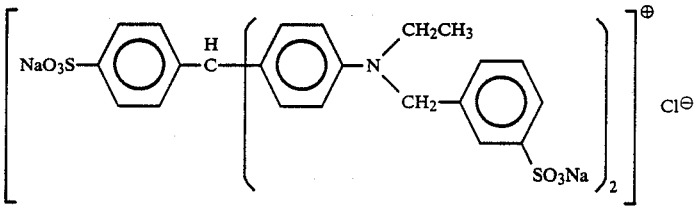

(2)S-1240 Dye (D781)

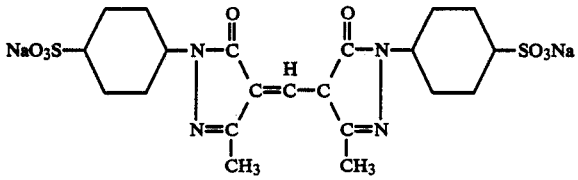

(3)Acid Violet Dye (D720)

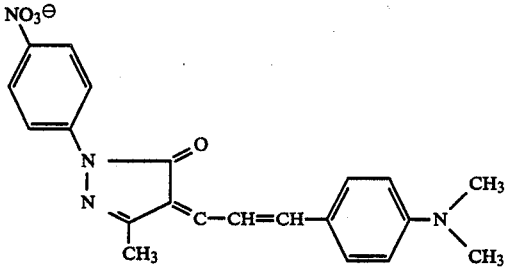

These ingredients were thoroughly mixed and split into portions of about 3040 g of each. Six portions were used for this example with further additions and treatments as follows:

| Example No. | Crosslinking(1) Agent (10% Aq. Soln) (g) | Conductive(2) Polymer (2% Aq. Soln) (g) |
|---|---|---|
| 1 | 42 | 175 |
| 2 | 84 | 74 |
| 3 | 84 | 175 |
| 4 | 126 | 70 |
| 5 | 100 | 125 |
| Control 1 | 0 | 0 |
| Control 2 Sample 3 from Ex. 1, U.S. Pat. No. 4,585,730 | | |

A sample of each of the above solutions was coated on a 0.004 inch (0.10 mm) polyethylene terephthalate, resin subbed (both sides) film which had been coated previously with an antistatic layer similar to that described by Miller U.S. Pat. No. 4,701,403, Solution No. 4 of Example 1. Each of the aforementioned solutions was coated over the described antistatic layer to give a coating weight of ca. 55 mg/dm$^2$. After drying, the surface resistivity of each layer was measured following the procedures found in Cho U.S. Pat. No. 4,585,730, Example 1, column 4. In each case, with the exception of Control No. 1, the static protection was excellent. Each sample was then run through a standard photographic processor (developer, fixer, wash an dry) and the surfaces were then examined for static resistivity and adhesion. In the case of Examples 1–5 resistivity and adhesion were found to be excellent. None of the material had come off during processing and all of the antistatic transmission qualities were maintained. In the case of Controls 1 and 2, adhesion was poor, much of the layer had come off during the processing step. Control 2 static protection was poorer than that of Examples 1 to 5.

EXAMPLES 6 TO 19

To text the efficacy of another crosslinking agent and another conductive polymer or combination of conductive polymers within the metes and bounds of this invention, a large sample of the antihalation solution of Examples 1–5, above, was prepared and divided into 14 portions of 3040 gms as described therein. Additions were made to each portion as shown below:

| Example No. | Chrome Alum Cross-linking Agent (2% Aq. Soln) (g) | Conduc-(1) tive Polymer I (10% Aq. Soln) (q) | Conduc-(2) tive Polymer II (10% Aq. Soln) (g) | pH |
|---|---|---|---|---|
| 6 | 0 | 10 | 10 | 5.0 |
| 7 | 20 | 10 | 0 | 5.0 |
| 8 | 0 | 20 | 10 | 5.0 |
| 9 | 20 | 20 | 0 | 5.0 |
| 10 | 10 | 10 | 10 | 5.0 |
| 11 | 20 | 20 | 10 | 5.0 |
| 12 Control | 10 | 0 | 0 | 5.0 |
| 13 | 0 | 10 | 10 | 7.0 |
| 14 | 20 | 10 | 0 | 7.0 |
| 15 | 0 | 20 | 10 | 7.0 |
| 16 | 20 | 20 | 0 | 7.0 |
| 17 | 10 | 10 | 10 | 7.0 |
| 18 | 20 | 20 | 10 | 7.0 |
| 19 Control | 10 | 0 | 0 | 7.0 |

(1)coco amide betaine

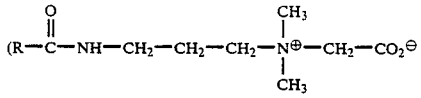

manufactured by Alkaril Chemicals, Ltd. and sold as Alkateric CAB ®.
(2)same as the conductive polymer of Ex. 1–5 above.

Samples of each solution were then applied to film supports containing an antistatic layer as described in Examples 1–5. Each sample was tested for static and adhesion as also described in Examples 1 to 5. In the case of controls (Examples 12 and 19), there was a noticeable lack of static protection in both the pre-processed and processed samples and adhesion of the antihalation layer to the antistatic layer was poor. In the other Examples (6–11 and 13–18) static protection was good to excellent, with those coated at pH 7 being better than those at pH 5. Adhesion was excellent in all of these samples indicating that other conductive polymers, alone or in combination will function within this invention.

I claim:

1. A photographic element consisting essentially of a support, at least one silver halide emulsion layer on one side of said support, and on the opposite side of said support in order are (a) a layer containing an antistatic agent and (b) an auxiliary layer consisting essentially of at least one crosslinkable conductive polymer having frunctionally attached carboxylic acid groups selected from the group consisting of poly(sodium styrene sulfonate-maleic anhydride), hexadecyl betaine, alkyldimethyl betaines, carboxylated imidazolines, coco amido betaines, and mixtures thereof and a crosslinking agent for the conductive polymer selected from the group consisting of a polyfunctional aziridine, chrome alum, carbodiimides, and isoxazolinium salts dispersed in a gelatin binder, the auxiliary layer coated from an aqueous solution on said antistatic layer at a pH of 3 to 12, the crosslinkable conductive polymer being present in an amount of 0.5 to 30% by weight based on the weight of the gelatin binder, and the crosslinking agent being present in an amount of 0.5 to 5% by weight based on the weight of gelatin binder, whereby the antistatic properties of the antistatic layer are conducted through the auxiliary layer.

2. A photographic film according to claim 1 wherein the auxiliary layer is replaced by two separately coated gelatin-containing layers, the first coated layer containing at least one crosslinkable conductive polymer and the second coated layer containing a crosslinking agent.

3. A photographic film according to claim 1 wherein the crosslinkable conductive polymer is poly(sodium polystyrene sulfonate-maleic anhydride).

4. A photographic film according to claim 2 wherein the crosslinkable conductive polymer is poly(sodium polystyrene sulfonate-maleic anhydride).

5. A photographic film according to claim 1 wherein the crosslinking agent is a polyfunctional aziridine.

6. A photographic film according to claim 2 wherein the crosslinking agent is a polyfunctional aziridine.

7. A photographic film according to claim 5 wherein the polyfunctional aziridine is pentaerythritol-tri-beta-(2-methyl aziridine).

8. A photographic film according to claim 6 wherein the polyfunctional aziridine is pentaerythritol-tri-beta-(2-methyl aziridine).

9. A photographic film according to claim 1 wherein the support is a polyethylene terephthalate film.

10. A photographic film according to claim 1 wherein the silver halide emulsion is covered with a protective overcoat layer.

11. A photographic film consisting essentially of a polyethylene terephthalate film support, at least one silver halide emulsion layer on one side of the support, the emulsion layer being overcoated with a protective overcoat layer, and on the opposite side of the support in order are (a) layer containing an antistatic agent and (b) an auxiliary layer consisting essentially of a crosslinkable conductive polymer selected from the group consisting of poly(sodium styrene sulfonatemaleic anhydride, hexadecyl betaine, alkyldimethyl betaines, carboxylated imidazolines, coco amido betaines, and mixtures thereof, and a crosslinking agent selected from the group consisting of a polyfunctional aziridine, chrome alum, carbodiimides, and isoxazolinium salts, dispersed in a gelatin binder, coated from an aqueous solution on said antistatic layer at a pH of 3 to 12, wherein the crosslinkable conductive polymer is present in an amount of 0.5 to 30% by weight and the crosslinking agent is present in an amount of 0.5 to 5% by weight, both weights based on the weight of gelatin binder, whereby the antistatic properties of the antistatic layer are conducted through the auxiliary layer.

12. A photographic film according to claim 11 wherein the auxiliary layer (b) is replaced by a crosslinkable conductive polymer/gelatin layer followed by a crosslinking agent/gelatin layer.

13. A photographic film according to claim 11 wherein the crosslinkable conductive polymer is present in an amount of 1.5 to 2.5% by weight based on the weight of gelatin binder.

14. A photographic film according to claim 13 wherein the crosslinking agent is present in an amount of 2 to 3% by weight based on the weight of gelatin binder.

15. A photographic film according to claim 11 wherein the crosslinkable conductive polymer is poly(-sodium styrene sulfonate-maleic anhydride) and the crosslinking agent is pentaerythritol-tri-beta-(2-methyl aziridine).

16. A photographic film according to claim 12 wherein the crosslinkable conductive polymer is poly(-sodium styrene sulfonate-maleic anhydride) and the crosslinking agent is pentaerythritol-tri-beta-(2-methyl aziridine).

* * * * *